US008989646B2

(12) United States Patent
Kadota et al.

(10) Patent No.: US 8,989,646 B2
(45) Date of Patent: Mar. 24, 2015

(54) CLEANING DEVICE, IMAGE CARRIER UNIT, AND IMAGE FORMING APPARATUS

(71) Applicant: KYOCERA Document Solutions Inc., Osaka (JP)

(72) Inventors: Masaki Kadota, Osaka (JP); Shigeki Tsukahara, Osaka (JP); Koichi Hayashi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/914,455

(22) Filed: Jun. 10, 2013

(65) Prior Publication Data

US 2013/0336694 A1 Dec. 19, 2013

(30) Foreign Application Priority Data

Jun. 14, 2012 (JP) ..... 2012-134554

(51) Int. Cl.
*G03G 21/00* (2006.01)

(52) U.S. Cl.
CPC ..... *G03G 21/0058* (2013.01)
USPC ..... 399/346; 399/350; 399/357; 399/358

(58) Field of Classification Search
CPC ..... G03G 21/0035; G03G 21/0058
USPC ..... 399/343, 349, 350, 358
See application file for complete search history.

(56) References Cited

U.S. PATENT DOCUMENTS 6,795,682 B2 * 9/2004 Nakahara ..... 399/353
7,149,465 B2 * 12/2006 Amemiya et al. ..... 399/346
2003/0044196 A1 * 3/2003 Amemiya et al. ..... 399/100
2008/0101834 A1 * 5/2008 Iwasaki ..... 399/357
2010/0189480 A1 * 7/2010 Hanano ..... 399/349
2011/0158722 A1 * 6/2011 Kobayashi et al. ..... 399/357

FOREIGN PATENT DOCUMENTS

JP 64-079783 A 3/1989
JP 10-260618 A 9/1998
JP 2005-215110 A 8/2005
JP 2009-008962 A 1/2009
JP 2009-204735 A 9/2009

OTHER PUBLICATIONS

Notice of Rejection mailed by Japan Patent Office on Jul. 22, 2014 in the corresponding Japanese patent application No. 2012-134554—8 pages.

* cited by examiner

*Primary Examiner* — Clayton E Laballe
*Assistant Examiner* — Ruifeng Pu
(74) *Attorney, Agent, or Firm* — Knobbe, Martens, Olson & Bear, LLP

(57) ABSTRACT

A cleaning device includes a rotary member, a sheet member, and a toner conveying member. The rotary member is held in contact with a cylindrical surface of an image carrier above a rotation axis of the image carrier. The sheet member is in contact at a distal end thereof with the cylindrical surface of the image carrier above the rotation axis of the image carrier and upstream of a contact position of the rotary member with the cylindrical surface of the image carrier in a direction of rotation of the image carrier. The toner conveying member is disposed above the sheet member and facing the peripheral surface of the rotary member.

11 Claims, 9 Drawing Sheets

CLEANING DEVICE, IMAGE CARRIER UNIT, AND IMAGE FORMING APPARATUS

INCORPORATION BY REFERENCE

This application claims priority to Japanese Patent Application No. 2012-134554 filed on Jun. 14, 2012, the entire contents of which are incorporated by reference herein.

BACKGROUND

The present disclosure relates to a cleaning device for use to clean an image carrier capable of carrying a toner image, an image carrier unit including the cleaning device, and an image forming apparatus including the cleaning device.

A known image forming apparatus for use to form an image on a sheet (recording medium) employs a technique in which the sheet passes up from below through a transfer nip formed between a photosensitive drum and a transfer roller. A toner image is formed on the photosensitive drum and the formed toner image is then transferred to the sheet at the transfer nip. The image forming apparatus further includes a fixing section. The sheet having the toner image transferred thereto undergoes a fixing process in the fixing section and is then output.

In this technique, in order to clean up residual toner on the photosensitive drum after the transfer of the toner image at the transfer nip, a cleaning device is disposed facing the photosensitive drum. In the case where, as above, the sheet passes up from below through the transfer nip, the cleaning device located downstream of the transfer nip in the direction of rotation of the photosensitive drum is mostly disposed above the photosensitive drum.

When like this the cleaning device is disposed above the photosensitive drum, residual toner removed from the photosensitive drum may fall from around the cleaning device. Therefore, a toner sealing member is provided around the cleaning device and held in contact with the photosensitive drum in order to prevent residual toner from falling. However, if a large amount of toner piles up on top of the toner sealing member, the toner presses the toner sealing member against the photosensitive drum. Thus, the contact pressure of the toner sealing member against the photosensitive drum is increased. If in this state paper powder of a sheet adheres to the cylindrical surface of the photosensitive drum at the transfer nip and moves to the distal end of the toner sealing member with the rotation of the photosensitive drum, the paper powder grows with time into a mass between the distal end of the toner sealing member and the cylindrical surface of the photosensitive drum. As a result, the mass of paper powder may lift up the distal end of the toner sealing member to cause troubles, such as toner leakage.

SUMMARY

A cleaning device according to the present disclosure includes a rotary member, a sheet member, and a toner conveying member.

The rotary member includes a peripheral surface held in contact with a cylindrical surface of an image carrier above a rotation axis of the image carrier. The rotary member is configured to be driven into rotation so that the peripheral surface thereof travels, at a contact position thereof with the image carrier, in the same direction as but with a linear speed difference from the image carrier and thereby allow toner deposited on the cylindrical surface of the image carrier to adhere to the peripheral surface of the rotary member.

The sheet member includes a distal end extending toward the cylindrical surface of the image carrier. The sheet member is in contact at the distal end with the cylindrical surface of the image carrier above the rotation axis thereof and upstream of the contact position of the rotary member in a direction of rotation of the image carrier.

The toner conveying member includes a rotation axis extending in a direction of length of the rotary member. The toner conveying member is disposed above the sheet member and facing the peripheral surface of the rotary member. The toner conveying member further includes a spiral member provided around the rotation axis thereof to extend in an axial direction of the rotation axis and is configured to be driven into rotation about the rotation axis.

DETAILED DESCRIPTION

Figure 1:
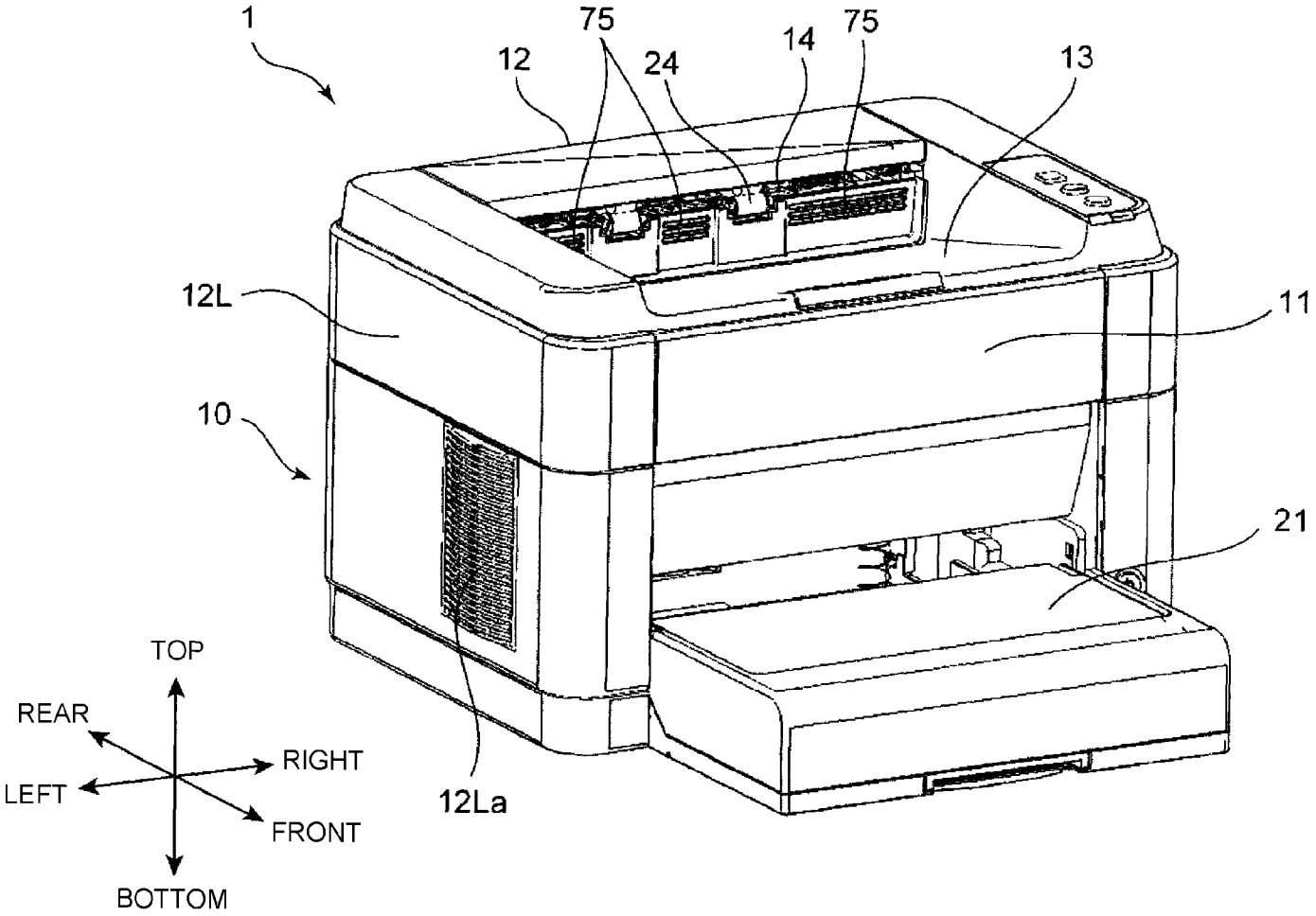
FIG. 1 is a perspective view showing the appearance of an image forming apparatus according to an embodiment of the present disclosure.
Figure 2:
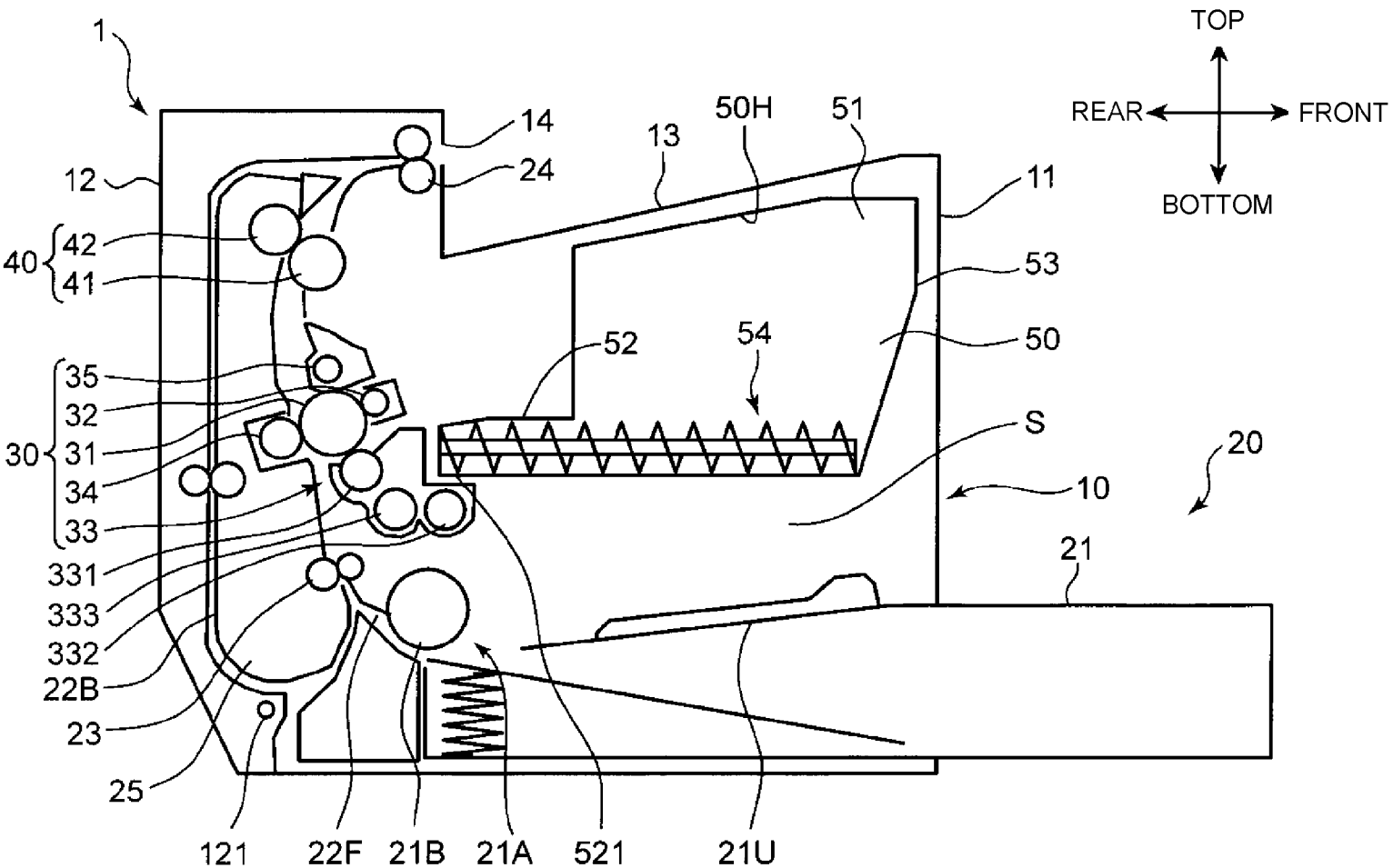
FIG. 2 is a cross-sectional view showing the internal structure of the image forming apparatus according to the above embodiment of the present disclosure.

Hereinafter, a description will be given of an embodiment as one aspect of the present disclosure. FIG. 1 is a perspective view showing the appearance of an image forming apparatus 1 according to the embodiment of the present disclosure. FIG. 2 is a sectional side view showing the internal structure of the image forming apparatus 1 according to the embodiment of the present disclosure. Here, a black and white printer is exemplified as the image forming apparatus 1. However, the image forming apparatus may be a copier, a facsimile machine, a multifunction peripheral having these functions or an image forming apparatus capable of forming color images.

The image forming apparatus 1 includes a body housing 10 having an approximately cuboid housing structure and further includes a paper feed section 20, an image forming section 30, a fixing section 40, and a toner container 50 all of which are housed in the body housing 10.

The body housing 10 includes a front cover 11 on the front side and a rear cover 12 on the rear side. When the front cover 11 is opened, the toner container 50 is exposed on the front side. Thus, the user can take out the toner container 50 from the front side of the body housing 10 when the toner container 50 is out of toner. The rear cover 12 is a cover that can be opened in the event of a sheet jam and during maintenance. Each of the image forming section 30 and the fixing section 40 can be taken out as a unit from the rear side of the body housing 10 by opening the rear cover 12. Furthermore, the body housing 10 is provided at both lateral sides with a left cover 12L (see FIG. 1) and a right cover 12R (not seen in FIG. 1) opposite to the left cover 12L, each of which extends in the vertical direction. A front portion of the left cover 12L is provided with an air inlet 12La to take air into the body housing 10. The top surface of the body housing 10 is provided with a paper output section 13 to which a sheet after image formation is to be output. Various devices for use in performing image formation are disposed in the interior space S (see FIG. 2) defined by the front cover 11, the rear cover 12, the left cover 12L, the right cover 12R, and the paper output section 13.

The paper feed section 20 includes a paper feed cassette 21 capable of containing sheets to be subjected to an image forming process (see FIG. 2). The paper feed cassette 21 partly extends forwardly beyond the front surface of the body housing 10. The top surface of a portion of the paper feed cassette 21 housed in the body housing 10 is covered with a paper feed cassette top plate 21U. The paper feed cassette 21 includes a sheet containing space in which a bundle of sheets are contained, a lift plate configured to lift up the bundle of sheets for the purpose of paper feed, and so on. A sheet forwarding part 21A is provided above the rear end of the paper feed cassette 21. In the sheet forwarding part 21A, a paper feed roller 21B is disposed to forward the uppermost one of the bundle of sheets in the paper feed cassette 21 for each operation.

The image forming section 30 performs an image forming process for forming a toner image on a sheet forwarded from the paper feed section 20. The image forming section 30 includes a photosensitive drum 31 (image carrier) and further includes a charging device 32, an exposure device (not seen in FIG. 2), a developing device 33, a transfer roller 34, and a cleaning device 35 all of which are disposed around the photosensitive drum 31. The image forming section 30 is disposed between the left cover 12L and the right cover 12R.

Figure 3:
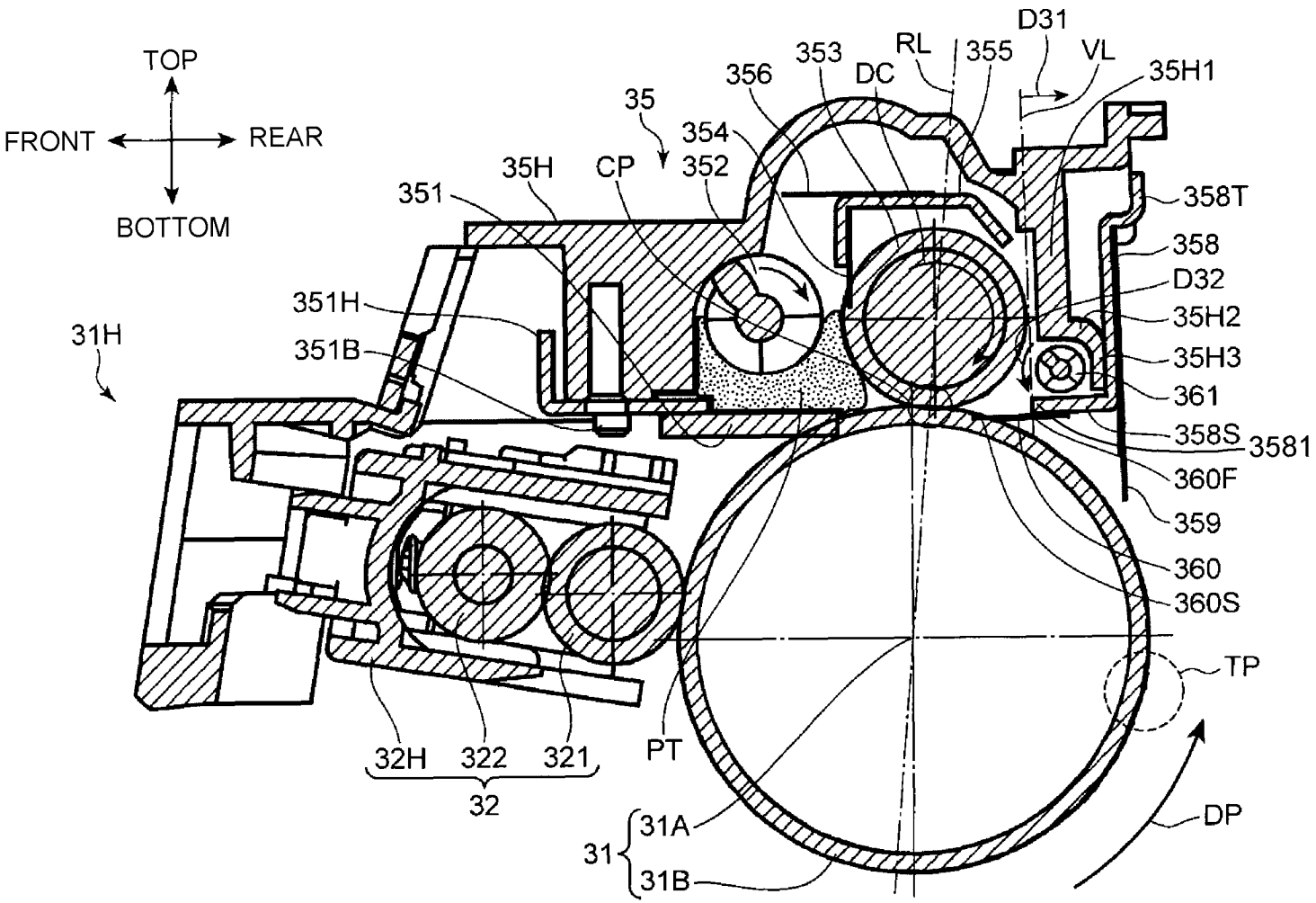
FIG. 3 is a cross-sectional view showing the internal structure of an image carrier unit in the above embodiment of the present disclosure.

The photosensitive drum 31 has a rotation axis 31A and includes a cylindrical surface 31B rotatable about the rotation axis 31A (see FIG. 3). An electrostatic latent image can be formed on the cylindrical surface 31B and a toner image corresponding to the electrostatic latent image can be carried on the cylindrical surface 31B. An example of the photosensitive drum 31 that can be used is a photosensitive drum in which an amorphous silicon (a-Si) based material is used as a photosensitive material.

The charging device 32 is configured to uniformly charge the surface of the photosensitive drum 31 and includes a charging roller held in contact with the photosensitive drum 31.

The cleaning device 35 includes a cleaning blade and so on. The cleaning device 35 cleans toner left behind on the peripheral surface of the photosensitive drum 31 having undergone the transfer of a toner image and conveys the toner to an unshown recovery device. Furthermore, the photosensitive drum 31, the charging device 32, and the cleaning device 35 are configured in combination as a drum unit 31H (an example of the image carrier unit, see FIG. 3). The cleaning device 35 and the drum unit 31H will be described in detail later.

The exposure device includes a laser light source and optical elements, including a mirror and a lens. The exposure device irradiates the peripheral surface of the photosensitive drum 31 with light modulated based on image data given by an external device, such as a personal computer, to form an electrostatic latent image. The developing device 33 supplies toner to the peripheral surface of the photosensitive drum 31 in order to develop the electrostatic latent image on the photosensitive drum 31 to form a toner image. The developing device 33 includes: a developing roller 331 capable of carrying toner to be supplied to the photosensitive drum 31; and first and second conveying screws 332, 333 configured to circulate and convey a developer while agitating the developer inside an unshown development housing.

The transfer roller 34 is a roller configured to transfer a toner image formed on the peripheral surface of the photosensitive drum 31 to a sheet. The transfer roller 34 is held in contact with the cylindrical surface 31B of the photosensitive drum 31 to form a transfer nip TP (see FIG. 3). The transfer roller 34 is configured to be given a transfer bias of reverse polarity to the toner.

The fixing section 40 performs a fixing process for fixing the transferred toner image on the sheet. The fixing section 40 includes: a fixing roller 41 internally provided with a heat source; and a pressure roller 42 pressed against the fixing roller 41 and forming a fixing nip with the fixing roller 41. When the sheet having the toner image transferred thereto is passed through the fixing nip, the toner image is fixed on the sheet by heating from the fixing roller 41 and pressing from the pressure roller 42.

The body housing 10 is internally provided with a main conveyance path 22F and a reverse conveyance path 22B in order to convey sheets. The main conveyance path 22F extends from the sheet forwarding part 21A of the paper feed section 20 via the image forming section 30 and the fixing section 40 to a paper output port 14 provided facing the paper output section 13 located at the top surface of the body housing 10. The reverse conveyance path 22B is a conveyance path for use to return the sheet one side of which has already been subjected to printing to a position of the main conveyance path 22F upstream of the image forming section 30.

The main conveyance path 22F (sheet conveyance path) is extended to allow a sheet to pass up from below through the transfer nip TP formed between the photosensitive drum 31 and the transfer roller 34. Furthermore, a registration roller pair 23 is disposed in the main conveyance path 22F upstream of the transfer nip TP. The sheet is once stopped between the registration roller pair 23 to correct any skew and then forwarded therefrom to the transfer nip with a predetermined timing for image transfer. A plurality of conveyance rollers configured to convey sheets are disposed at various points of the main conveyance path 22F and reverse conveyance path 22B. For example, a paper output roller pair 24 as the conveyance rollers is disposed near the paper output port 14.

Next, a description will be given of the structure of the drum unit 31H in this embodiment with reference to FIGS. 3 to 6. FIG. 3 is an enlarged cross-sectional view of the drum unit 31H in this embodiment. Note that FIG. 3 is shown as a view in which the right-and-left direction of the plane of FIG. 2 (the front-to-rear direction of the image forming apparatus 1 in FIG. 2) is inverted.

Referring to FIG. 3, the drum unit 31H includes the photosensitive drum 31, the charging device 32, and the cleaning device 35. The drum unit 31H further includes an unshown pair of side plates (not shown) at both ends in the right-and-left direction (the direction perpendicular to the plane of FIG. 3). The photosensitive drum 31 is rotatably supported by the pair of side plates. Furthermore, the charging device 32 and the cleaning device 35 are supported at positions facing the photosensitive drum 31 by the pair of side plates. The photosensitive drum 31 is driven into rotation in the direction of the arrow DP in FIG. 3. The side plates of the drum unit 31H are provided with their respective fixing parts (not shown). The fixing parts are designed to fix the drum unit 31 to the body housing 10 of the image forming apparatus 1 when the drum unit 31H is fitted to the body housing 10 of the image forming apparatus 1. Thus, the drum unit 31H is positioned in place in the image forming apparatus 1. Each of the fixing parts is formed of, for example, a fastening hole through which a screw can be fastened.

The charging device 32 is disposed forwardly of the photosensitive drum 31. The charging device 32 includes a charging roller 321, a cleaning roller 322, and a charging housing 32H. The charging housing 32H has an opening facing the cylindrical surface (peripheral surface) of the photosensitive drum 31 in side view shown in FIG. 3. The charging roller 321 and the cleaning roller 322 are rotatably supported inside the charging housing 32H.

The charging roller 321 is a roll member whose surface is made of rubber material. A charging voltage can be applied to the charging roller 321 by an unshown bias applying device. The charging roller 321 is held in contact with the peripheral surface of the photosensitive drum 31 and configured to be rotated by following the rotation of the photosensitive drum 31. The charging roller 321 to which a charging voltage is applied uniformly charges the peripheral surface of the photosensitive drum 31.

The cleaning roller 322 is held in contact with the charging roller 321 and configured to rotate with a linear speed difference from the charging roller 321. The cleaning roller 322 is a brush roller made of electrically conductive nylon fibers. When the charging roller 321 is in contact with the surface of the photosensitive drum 31, toner and foreign matters adhere to the surface of the charging roller 321. Furthermore, when a charging voltage is applied to the charging roller 321 to generate a discharge at the contact position of the charging roller 321 with the photosensitive drum 31, discharge products are deposited on the surface of the charging roller 321. The cleaning roller 322 is rotated in contact with and with a linear speed difference from the charging roller 321, so that toner, foreign matters, and discharge products deposited on the surface of the charging roller 321 can be appropriately removed.

The cleaning device 35 is disposed above the photosensitive drum 31. The cleaning device 35 includes a cleaner housing 35H, a cleaning blade 351, a first conveying screw 352, and an abrasive roller 353. The cleaning device 35 further includes a scraper 354, a scraper holder 355, and an upper seal 356. The cleaning device 35 still further includes a plate 358, an anti-drag sheet 359, a toner seal 360, and a second conveying screw 361.

The cleaner housing 35H is a housing that supports various members inside the cleaning device 35. Referring to FIG. 3, the cleaning device 35 is disposed to cover the photosensitive drum 31 and the charging device 32 from above. Particularly, a front portion of the cleaner housing 35H as viewed in FIG. 3 is placed above the charging roller 321. A midportion of the cleaner housing 35H in the front-to-rear direction in side view of FIG. 3 has a shape raised in an arc. A rear portion of the cleaner housing 35H is defined by a housing rear wall 35H1 (second standing wall). The housing rear wall 35H1 is a wall portion extended in the vertical direction. The housing rear wall 35H1 is disposed facing the abrasive roller 353 to be described later. Furthermore, an upper wall 35H2 and a sidewall 35H3 are provided at the lower end of the housing rear wall 35H1. The upper wall 35H2 is a wall portion extended in the front-to-rear direction from the lower end of the housing rear wall 35H1. The upper wall 35H2 (an example of the upper wall portion) is formed by bending a lower end portion of the housing rear wall 35H1 rearwardly. On the other hand, the sidewall 35H3 (an example of the first standing wall) is a wall portion extended vertically from the rear end of the upper wall 35H2. The sidewall 35H3 is formed by bending a rear end portion of the upper wall 35H2 downwardly. The upper wall 35H2 and the sidewall 35H3 are disposed facing the second conveying screw 361 from above and behind, respectively.

In this manner, the sidewall 35H3 is provided lateral to the second conveying screw 361 and to the opposite side thereof to the abrasive roller 353 to extend vertically and face the second conveying screw 361. Thus, toner can be conveyed by the second conveying screw 361 while being squeezed in between the second conveying screw 361 and the sidewall 35H3. Therefore, the toner can be stably conveyed in the axial direction of the photosensitive drum 31 by the second conveying screw 361.

In addition, since the upper wall 35H2 is provided to cover the second conveying screw 361 from above, the space above the second conveying screw 361 is terminated by the upper wall 35H2. Therefore, it can be prevented that the toner being conveyed by the second conveying screw 361 is driven away from the second conveying screw 361 by centrifugal force thereof.

The cleaning blade 351 is disposed horizontally along the bottom of the cleaner housing 35H. The cleaning blade 351 is a plate-like member made of rubber material. The cleaning blade 351 is supported by a blade holder 351H. The blade holder 351H is a sheet metal member of L-shape in cross-sectional view of FIG. 3. The blade holder 351H is secured to the cleaner housing 35H by a blade mounting screw 351B. The cleaning blade 351 and the blade holder 351H are secured to each other by an adhesive. As a result, a fixed end of the cleaning blade 351 is formed. On the other hand, a distal end of the cleaning bade 351 is a free end and is held in contact with the peripheral surface of the photosensitive drum 31. The distal end of the cleaning blade 351 is held in contact with the cylindrical surface 31B of the photosensitive drum 31 downstream of the abrasive roller 353 to be described later in a direction of rotation of the photosensitive drum 31 (the direction of the arrow DP). As a result, residual (deposited) toner on the peripheral surface of the photosensitive drum 31 is removed by the distal end of the cleaning blade 351.

The first conveying screw 352 is rotatably supported above the cleaning blade 351 by the cleaner housing 35H. The first conveying screw 352 includes a shaft and a spiral fin member (spiral member) provided around the shaft. The first conveying screw 352 conveys collected toner PT, which has been scraped by and accumulates on the cleaning blade 351, in the axial direction of the rotation axis 31A of the photosensitive drum 31.

The abrasive roller 353 (an example of the rotary member) is disposed behind the first conveying screw 352. The abrasive roller 353 includes a peripheral surface held in contact with the cylindrical surface 31B of the photosensitive drum 31 above the rotation axis 31A thereof. For example, the abrasive roller 353 is held in contact with the cylindrical surface 31B of the photosensitive drum 31 somewhere in between the transfer nip TP and a position right above the rotation axis 31A of the photosensitive drum 31. More specifically, the abrasive roller 353 is held in contact with the cylindrical surface 31B at the position right above the rotation axis 31A of the photosensitive drum 31 or slightly upstream of the position in the direction of rotation of the photosensitive drum 31. The contact position of the abrasive roller 353 with the cylindrical surface 31B is defined as a contact position CP.

The abrasive roller 353 is a rubber roller whose surface is roughened. The abrasive roller 353 is rotated (in the direction of the arrow DC) with a linear speed difference from the photosensitive drum 31 while being held in contact with the surface of the photosensitive drum 31. The surface of the abrasive roller 353 traps toner deposited on the cylindrical surface 31B of the photosensitive drum 31. Furthermore, the abrasive roller 353 grinds deposits, such as discharge products, deposited on the surface of the photosensitive drum 31. During the grinding, a constant amount of toner adheres to the peripheral surface of the abrasive roller 353, resulting in improved performance of removal (grinding) of the discharge products.

The scraper 354 is a vertically extended plate-like member. In this embodiment, the scraper 354 is formed of a 0.05 mm thick SUS sheet. The lower end of the scraper 354 is held in contact with the peripheral surface of the abrasive roller 353. The lower end of the scraper 354 is held in contact with the peripheral surface of the abrasive roller 353 against the direction of rotation of the abrasive roller 353 (the direction of the arrow DC). The scraper 354 is held in contact with the peripheral surface of the abrasive roller 353 with a predetermined resilient force, so that the amount of toner having adhered to the peripheral surface of the abrasive roller 353 is regulated. As a result, the toner collected by the abrasive roller 353 falls on the cleaning blade 351. Furthermore, the amount of toner adhering to the peripheral surface of the abrasive roller 353 is evenly distributed, which prevents the abrasive roller 353 from varying in performance of removal of discharge products.

The scraper 354 is mounted to the scraper holder 355. The scraper holder 355 is disposed to cover the abrasive roller 353 from above. The scraper holder 355 is formed of a bent sheet metal material. A midportion of the scraper holder 355 extends horizontally. A front portion of the scraper holder 355 is bent downward and supports the scraper 354. A rear portion of the scraper holder 355 is bent rearward and downward.

The upper seal 356 is secured on the scraper holder 355. One end of the upper seal 356 is supported on the midportion of the scraper holder 355 and the other end thereof is placed to project forwardly beyond the scraper holder 355. The upper seal 356 has the function, when the toner having adhered to the peripheral surface of the abrasive roller 353 is scraped by the scraper 354, of blocking upwardly scattered toner particles.

The plate 358 is disposed behind and facing the housing rear wall 35H1. The plate 358 is a vertically extended sheet metal member. A plate upper portion 358T which is an upper end portion of the plate 358 is bent rearward and then curved upward. Furthermore, the plate 358 is secured to the cleaner housing 35H by a fastening screw located out of a paper passage area. A plate lower portion 358S (an example of the support member) which is a lower end portion of the plate 358 is disposed to bend forward. The plate lower portion 358S is disposed next to a lateral portion of the cleaner housing 35H. The plate lower portion 358S extends from the lateral portion of the cleaner housing 35H toward the cylindrical surface 31B of the photosensitive drum 31. One end of the toner seal 360 is attached to an end of the plate lower portion 358S located toward the cylindrical surface 31B. The plate lower portion 358S supports the toner seal 360.

The anti-drag sheet 359 is extended vertically along the plate 358. An upper portion of the anti-drag sheet 359 is secured to the plate 358 by adhesion to form a fixed end portion of the anti-drag sheet 359. On the other hand, a lower portion of the anti-drag sheet 359 is placed to project downward beyond the plate 358 and thus form a free end portion of the anti-drag sheet 359. A lower and distal end of the anti-drag sheet 359 is placed close to the peripheral surface of the photosensitive drum 31.

The toner seal 360 (an example of the sheet member) is extended horizontally along the plate lower portion 358S of the plate 358. The toner seal 360 is a 100 μm thick urethane sheet. A basal end portion (rear portion) of the toner seal 360 is secured to the plate lower portion 358S by adhesion. The basal end portion of the toner seal 360 forms a fixed end 360F of the toner seal 360. The fixed end 360F is a part of an adhering region of the toner seal 360 adhering to the plate lower portion 358S and is nearest to a distal end 360S of the toner seal 360 in the adhering region. In other words, the fixed end 360F refers to a part of the toner seal 360 located at the same position as an end 3581 of the plate lower portion 358S in a direction from these ends toward the cylindrical surface 31B of the photosensitive drum 31.

In the toner seal 360, its distal end 360S on the side opposite to its basal end extends toward the cylindrical surface 31B of the photosensitive drum 31. The distal end 360S forms a free end of the toner seal 360 and is in contact with the peripheral surface of the photosensitive drum 31. To sum up, the toner seal 360 is interposed between the plate lower portion 358S and the cylindrical surface 31B of the photosensitive drum 31 and, with its basal end attached to the plate lower portion 358S, its distal end 360S as the other end is in contact with the cylindrical surface 31B.

The distal end 360S of the toner seal 360 is located above the rotation axis 31A in side view shown in FIG. 3. The distal end 360S is in contact with the cylindrical surface 31B of the photosensitive drum 31 upstream of the abrasive roller 353 in the direction of rotation of the photosensitive drum 31. In this relation, the toner seal 360 extends in a direction of approach to a reference line RL connecting between the rotation axis 31A of the photosensitive drum 31 and the contact point CP thereof with the abrasive roller 353 in cross-sectional view orthogonal to the rotation axis 31A and then reaches the cylindrical surface 31B. The toner seal 360 has the function of preventing the toner from leaking from the interior of the cleaner housing 35H.

The second conveying screw 361 (an example of the toner conveying member) is disposed in a space defined by the upper wall 35H2, the sidewall 35H3, and the plate lower portion 358S. The shaft (rotation axis) of the second conveying screw 361 extends in the direction of length of the abrasive roller 353. The second conveying screw 361 is disposed above the toner seal 360 and facing the peripheral surface of the abrasive roller 353. The second conveying screw 361 is rotatably supported at both ends in the direction orthogonal to the plane of FIG. 3 by the cleaner housing 35H. The second conveying screw 361 includes the shaft and a fin member (an example of the spiral member). The fin member is provided around the shaft and has a spiral shape extending in the axial direction of the shaft. The second conveying screw 361 is driven into rotation about the axis of the shaft to convey the toner piled up on the toner seal 360 in the axial direction of the rotation axis 31A of the photosensitive drum 31.

The unshown exposure device, which is located downstream of the charging device 32 in the direction of rotation of the photosensitive drum 31, forms an electrostatic latent image on the photosensitive drum 31 whose peripheral surface has been uniformly charged by the charging roller 321 of the charging device 32. Then, the electrostatic latent image is made visible as a toner image by the developing device 33 (see FIG. 2) disposed below the photosensitive drum 31. The photosensitive drum 31 is rotated to travel from below upward at the transfer nip TP. Then, the toner image formed on the photosensitive drum 31 is transferred to a sheet being conveyed through the transfer nip TP from below upward.

Part of the toner image transferred to the sheet at the transfer nip TP remains as residual toner on the photosensitive drum 31. With the rotation of the photosensitive drum 31, the residual toner on the photosensitive drum 31 is conveyed from below upward to an area where the cleaning device 35 and the photosensitive drum 31 face each other.

Part of the residual toner conveyed to the area where the cleaning device 35 and the photosensitive drum 31 face each other adheres to the peripheral surface of the abrasive roller 353. Furthermore, the remaining residual toner having not adhered to the peripheral surface of the abrasive roller 353 is scraped by the cleaning blade 351.

Next, a description will be given of problems of the toner sealing member (sheet member) disposed in the cleaning device 35. Part of the toner having adhered to the peripheral surface of the abrasive roller 353 is scraped by the scraper 354. The residual toner passing over the distal end of the scraper 354 and still remaining on the peripheral surface of the abrasive roller 353 is traveled with the rotation of the abrasive roller 353 while passing through an area facing the scraper holder 355 and an area facing the housing rear wall 35H1. During the travel, the toner adhering to the peripheral surface of the abrasive roller 353 is removed away from the abrasive roller 353 by the centrifugal force of the abrasive roller 353. The toner removed away from the abrasive roller 353 is scattered in an area surrounded by the scraper holder 355, the housing rear wall 35H1, and the peripheral surface of the photosensitive drum 31.

Figure 4:
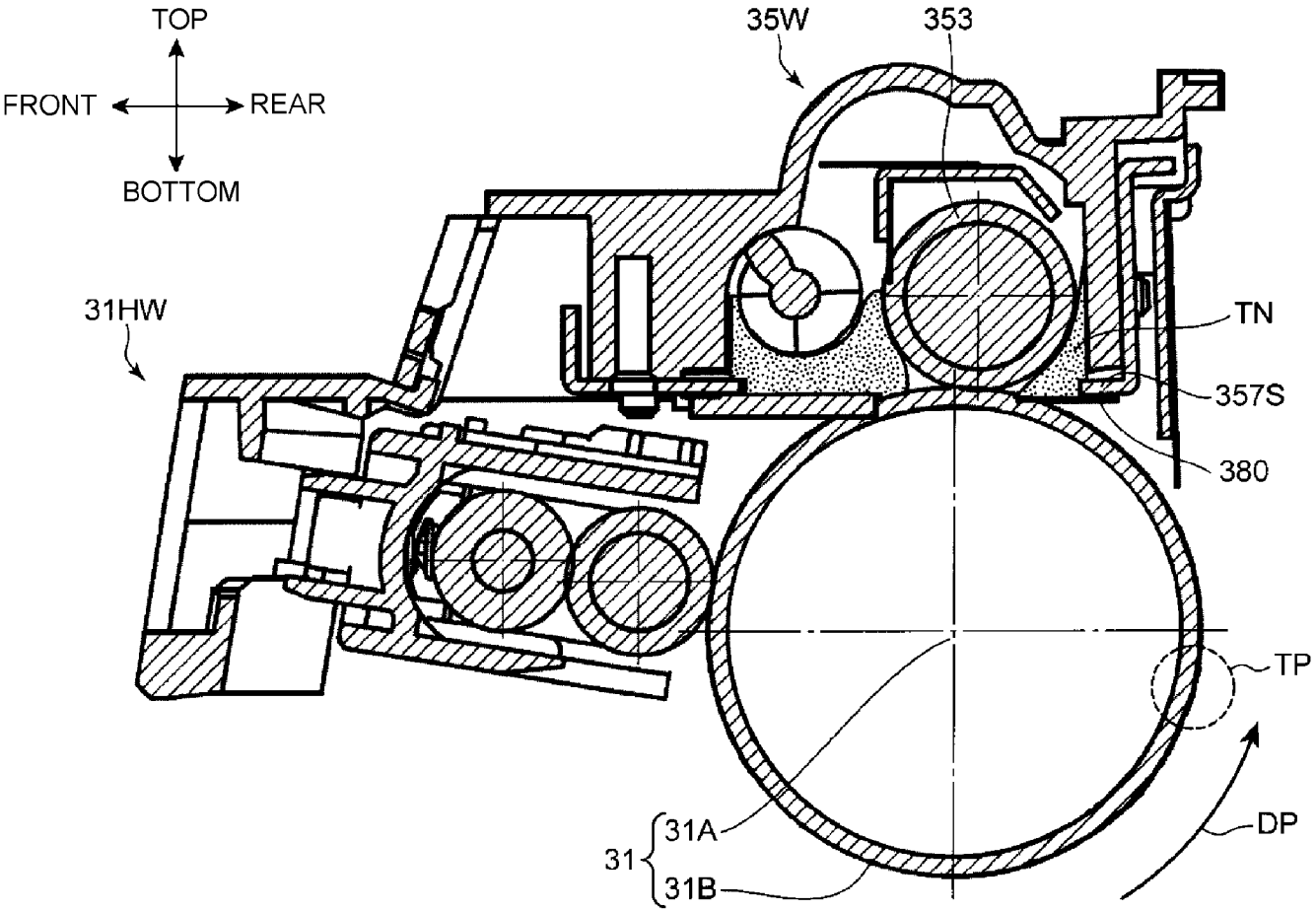
Fig. 4 Related Art
FIG. 4 is a cross-sectional view showing the internal structure of an image carrier unit for comparison with the present disclosure.

FIG. 4 is used for comparison with the cleaning device 35 according to the embodiment of the present disclosure and is a cross-sectional view of a drum unit 31HW equipped with a cleaning device 35W. The cleaning device 35W includes a toner seal 380. The toner seal 380, like the toner seal 360, is formed of a horizontally disposed urethane sheet. A basal end portion of the toner seal 380 is fixed and supported to a plate lower portion 357S. A distal end of the toner seal 380 forms a free end and is held in contact with the peripheral surface of the photosensitive drum 31.

Figure 5:
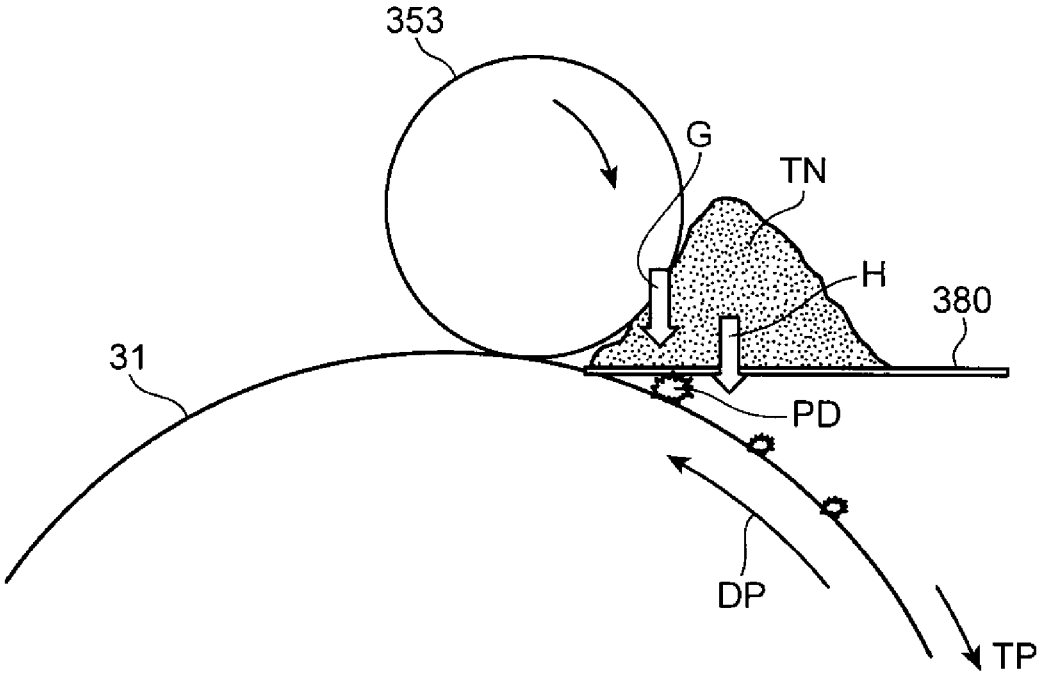
Fig. 5 Related Art
FIG. 5 is a schematic view for illustrating a state that toner piles up on a toner seal.
Figure 6:
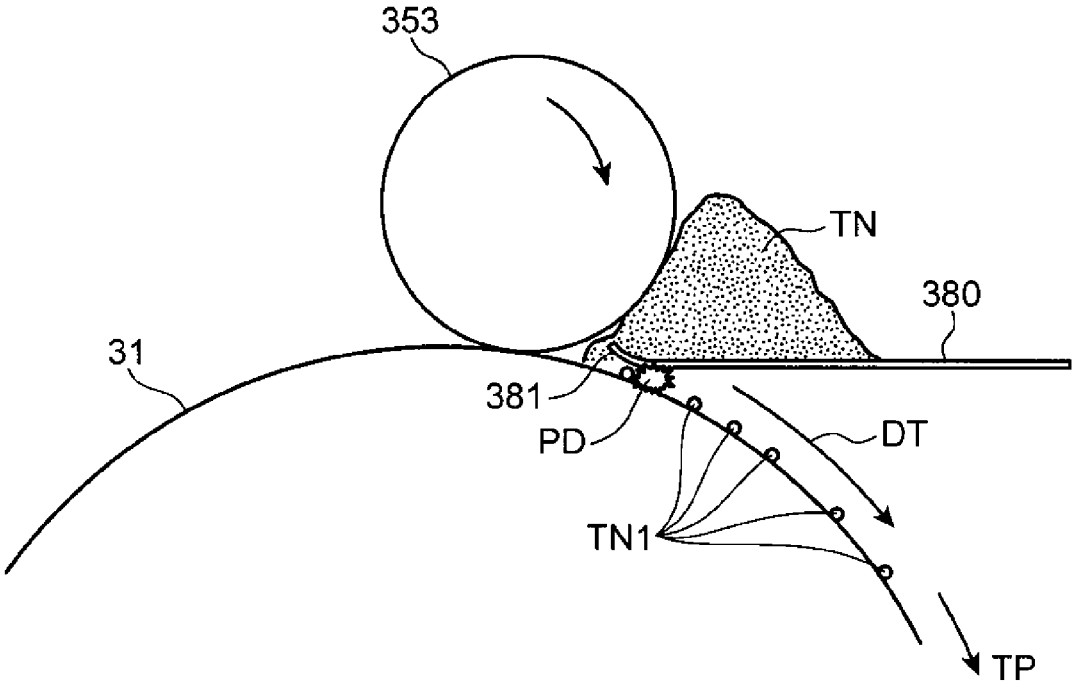
Fig. 6 Related Art
FIG. 6 is a schematic view for illustrating a state that the distal end of the toner seal is lifted up by a mass of paper powder.

Toner particles scattered from the peripheral surface of the abrasive roller 353 pile up on the toner seal 380 to form a toner accumulation TN. FIGS. 5 and 6 are views showing states of the toner seal 380 and the surrounding area during the formation of the toner accumulation TN. Referring to FIG. 5, the toner accumulation TN formed of toner particles scattered on the toner seal 380 is gradually raised mountain-high. As a result, the self-weight of the toner accumulation TN gives the toner seal 380 a pressing force as shown by the arrow H. If the toner particles scattered on the toner seal 380 further pile up, the slope of the toner accumulation TN comes into contact with the peripheral surface of the abrasive roller 353. Thus, as shown by the arrow G, a downward pressing force is applied to the toner accumulation TN with the rotation of the abrasive roller 353. As a result, the contact pressure to be applied to the peripheral surface of the photosensitive drum 31 by the toner seal 380 will be increased.

Furthermore, while the toner image is transferred to the sheet P at the transfer nip TP, paper powder having adhered to the surface of the sheet P may be transferred to the peripheral surface of the photosensitive drum 31. The paper powder having adhered to the peripheral surface of the photosensitive drum 31 is conveyed toward the distal end of the toner seal 380 with the rotation of the photosensitive drum 31. If the toner accumulation TN is not formed on the toner seal 380, the distal end of the toner seal 380 is in contact with the peripheral surface of the photosensitive drum 31 with a small contact pressure. In this case, the paper powder conveyed on the photosensitive drum 31 passes through between the distal end of the toner seal 380 and the peripheral surface of the photosensitive drum 31 and is then collected by the cleaning blade 351.

However, if the distal end of the toner seal 380 is pushed hard against the peripheral surface of the photosensitive drum 31 by the toner accumulation TN piled up on the toner seal 380, the paper powder cannot pass through between the distal end of the toner seal 380 and the peripheral surface of the photosensitive drum 31. As a result, as shown in FIG. 5, a mass PD of paper powder is formed between the distal end of the toner seal 380 and the peripheral surface of the photosensitive drum 31.

When the mass PD of paper powder grows with time, a portion of the toner seal 380 corresponding to a portion of the photosensitive drum 31 on which the mass PD exists is lifted up from the peripheral surface of the photosensitive drum 31 along the axial direction of the rotation axis 31A of the photosensitive drum 31 (see FIG. 6). As a result, the toner TN1 starts to leak from the toner accumulation TN. The toner TN1 falls along the peripheral surface of the photosensitive drum 31 with the force of the gravity (as shown by the arrow DT in FIG. 6). Then, the toner TN1 having reached the transfer nip TP adheres to the sheet P conveyed to the transfer nip TP. As a result, the sheet P will be contaminated with the toner.

As described above, the toner piled up on the toner seal 380 may create a mass PD of paper powder and finally contaminate the sheet P. To solve the above problems, in the cleaning device 35 according to this embodiment, the second conveying screw 361 is appropriately disposed above the toner seal 360.

In this embodiment, as shown in FIG. 3, the above-mentioned second conveying screw 361 is disposed above the toner seal 360. Particularly in this embodiment, the second conveying screw 361 is disposed above the toner seal 360 and in a space surrounded by the upper wall 35H2, the sidewall 35H3, and the plate lower portion 358S. In addition, even if the toner piles up on the toner seal 360 as shown in FIG. 4, the second conveying screw 361 collects toner particles of the piled-up toner accumulation TN in the axial direction of the photosensitive drum 31. This prevents that excess toner piles up on the toner seal 360. As a result, it can be prevented that the toner piled up on the toner seal 360 increases the contact pressure of the toner seal 360 against the photosensitive drum 31. Therefore, a mass PD of paper powder is less likely to be formed between the distal end of the toner seal 360 and the peripheral surface of the photosensitive drum 31. This prevents that the distal end of the toner seal 360 is lifted up from the peripheral surface of the photosensitive drum 31 to cause toner leakage. Hence, it can be effectively prevented that the sheet P conveyed to the transfer nip TP is contaminated with the toner falling down from the distal end of the toner seal 360.

Figure 7:
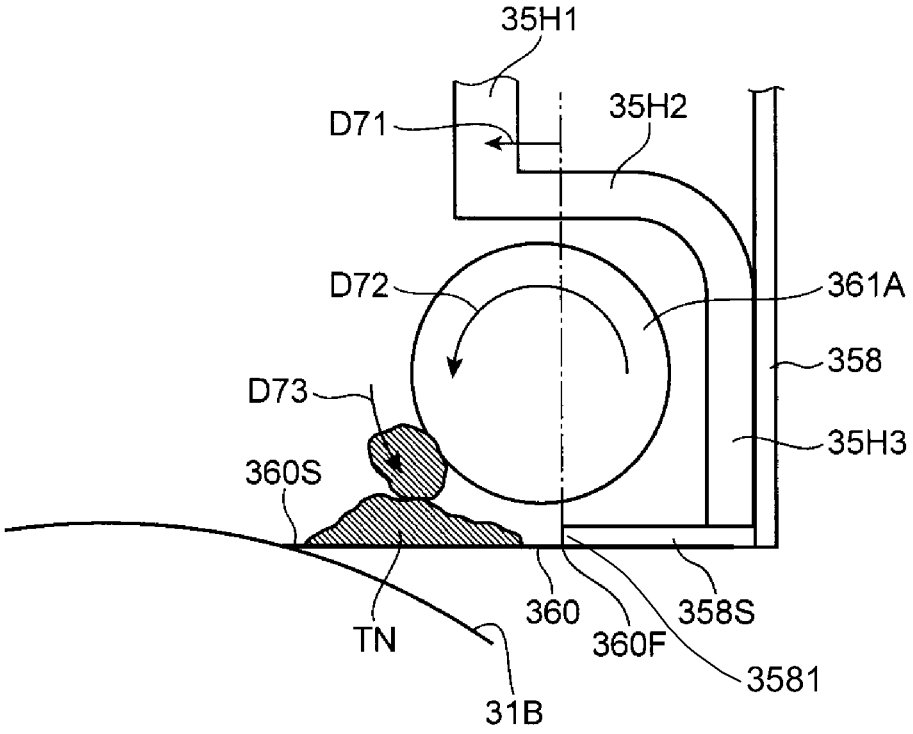
FIG. 7 is an enlarged cross-sectional view of a second conveying screw and the surrounding area in an embodiment of the present disclosure.
Figure 8:
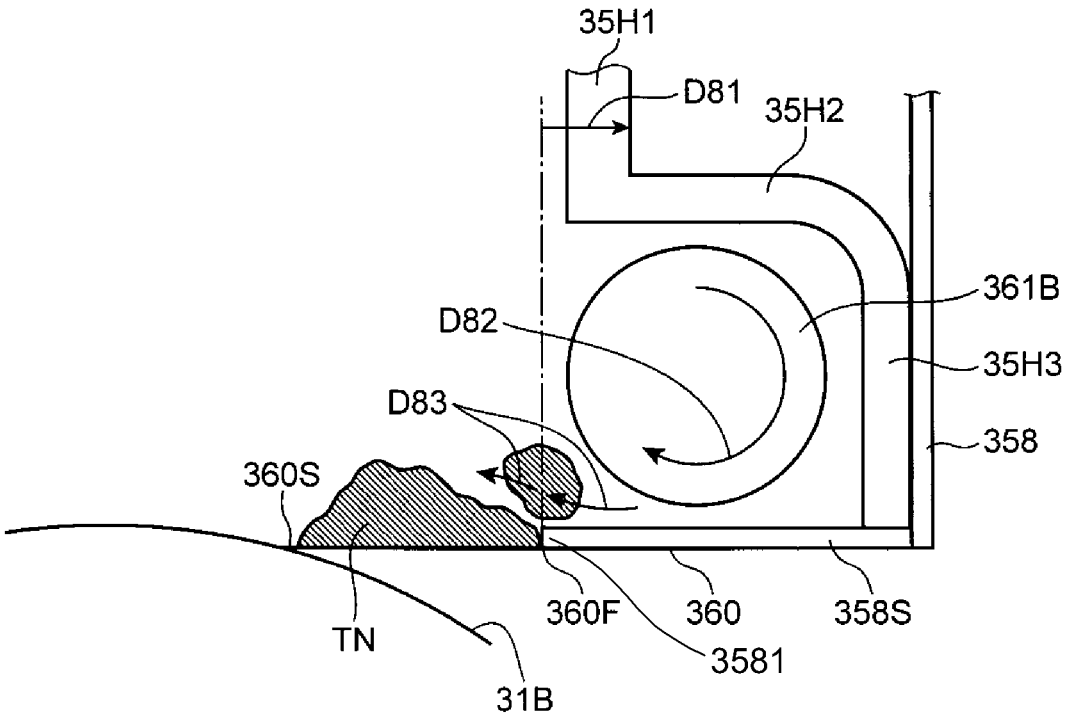
FIG. 8 is an enlarged cross-sectional view of a second conveying screw and the surrounding area in another embodiment of the present disclosure.

Next, a preferred embodiment of the second conveying screw 361 will be described in further detail. FIGS. 7 and 8 are enlarged cross-sectional views for illustrating different embodiments of the second conveying screw 361. As shown in FIG. 3, the peripheral edge of the rotating second conveying screw 361 is preferably disposed farther away from the distal end 360S of the toner seal 360 than the fixed end 360F of the toner seal 360 in the direction of extension of the toner seal 360. In other words, the second conveying screw 361 is preferably disposed to avoid that the peripheral edge of the fin member located above the plate lower portion 358S is located in an area nearer to the distal end 360S of the toner seal 360 with respect to the end 3581 of the plate lower portion 358S.

As shown in FIG. 7, if the peripheral edge of the second conveying screw 361A is located nearer to the distal end 360S (on the arrow D71 side) than the fixed end 360F, the toner conveyed by the rotation (in the direction of the arrow D72) of the second conveying screw 361A may press against the toner accumulation TN from above (in the direction of the arrow D73). Thus, the toner seal 360 may be partly pushed toward the photosensitive drum 31. For this reason, the peripheral edge of the rotating second conveying screw 361 is preferably disposed farther away from the distal end 360S of the toner seal 360 than the fixed end 360F of the toner seal 360. Thus, the above phenomenon can also be prevented. Since, even in the embodiment shown in FIG. 7, the toner particles of the toner accumulation TN are conveyed in the axial direction of the photosensitive drum 31, the lift-up of the distal end 361S of the toner seal 360 as shown in FIGS. 5 and 6 can be effectively prevented.

Furthermore, as shown by the arrow D32 of FIG. 3, the second conveying screw 361 is preferably driven into rotation so that the peripheral surface thereof travels, at the position thereof facing the abrasive roller 353, in the same direction as the peripheral surface of the abrasive roller 353. In other words, the second conveying screw 361 is preferably driven into rotation so that a portion of the peripheral edge of the fin member facing the peripheral surface of the abrasive roller 353 travels downward. In the above embodiment shown in FIG. 3, the abrasive roller 353 and the second conveying screw 361 are rotated so that their portions facing each other travel from above downward. Unlike this, in a second conveying screw 361B shown in FIG. 8, the peripheral edge of the rotating second conveying screw 361B is disposed farther away from the distal end 360S of the toner seal 360 (on the arrow D81 side) than the fixed end 360F of the toner seal 360 and the second conveying screw 361B is rotated so that its portion facing the abrasive roller 353 travels from below upward (in the direction of the arrow D82). In this case, as shown by the arrow D83, part of the toner may be sent toward the distal end 360S of the toner seal 360 with the rotation of the second conveying screw 361B. For this reason, as shown in FIG. 3, the second conveying screw 361 is preferably driven into rotation so that the peripheral surface thereof travels, at the position thereof facing the abrasive roller 353, in the same direction as the peripheral surface of the abrasive roller 353. Since, even in the embodiment shown in FIG. 8, the toner particles of the toner accumulation TN are conveyed in the axial direction of the photosensitive drum 31, the lift-up of the distal end 361S of the toner seal 360 as shown in FIGS. 5 and 6 can be effectively prevented.

Figure 9:
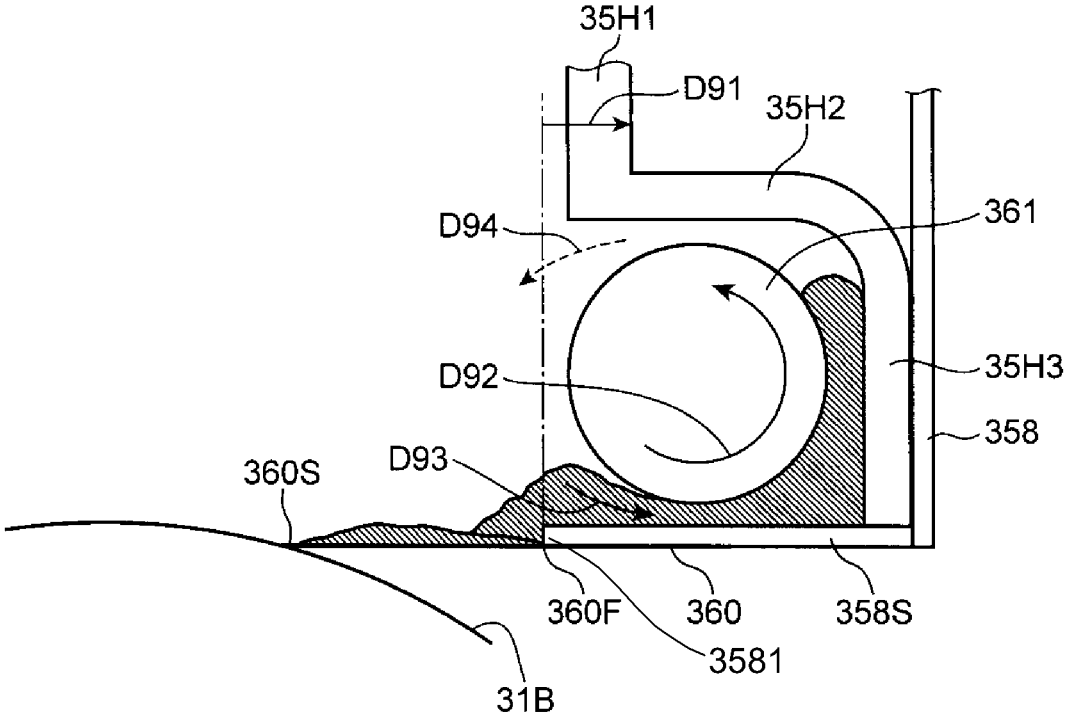
FIG. 9 is an enlarged cross-sectional view of a second conveying screw and the surrounding area in still another embodiment of the present disclosure.

From the above viewpoints, the most preferred embodiment of the second conveying screw 361 is shown in FIG. 9. The portion of the peripheral edge of the rotating second conveying screw 361 nearest to the abrasive roller 353 is disposed farther away from the distal end 360S of the toner seal 360 (on the arrow D91 side) than the fixed end 360F of the toner seal 360 and the second conveying screw 361 is rotated so that its portion (see FIG. 3) facing the abrasive roller 353 travels from above downward (in the direction of the arrow D92). In other words, the second conveying screw 361 is disposed to avoid that the peripheral edge of the fin member located above the plate lower portion 358S is located in an area nearer to the distal end 360S of the toner seal 360 with respect to the end 3581 of the plate lower portion 358S. Furthermore, the second conveying screw 361 is driven into rotation so that the portion of the peripheral edge of the fin member facing the peripheral surface of the abrasive roller 353 travels downward.

In this case, the toner piled up on the toner seal 360 is drawn in toward the sidewall 35H3 (as shown by the arrow D93) with the rotation of the second conveying screw 361. Furthermore, the toner is conveyed in the axial direction of the photosensitive drum 31 by the spiral fin member of the second conveying screw 361. Then, the toner is discharged into an unshown recovery tonner bottle disposed at an axial end of the drum unit 31H. In this structure, the toner drawn in toward the sidewall 35H3 is axially conveyed while being squeezed in between the second conveying screw 361 and the sidewall 35H3. During this conveyance, the toner is axially transported while moving up and down beside the sidewall 35H3 by gravity and the rotational force of the second conveying screw 361. Furthermore, since the upper wall 35H2 is disposed above and facing the second conveying screw 361, the toner is less likely to flow away from the upper edge of the second conveying screw 361 toward the distal end 360S as shown by the arrow D94.

Moreover, the housing rear wall 35H1 extends upward from the upper wall 35H2. The housing rear wall 35H1 is located farther away from the distal end 360S (on the arrow D91 side in FIG. 9) of the toner seal 360 than the fixed end 360F of the toner seal 360. In other words, the housing rear wall 35H1 is disposed opposite the distal end 360S of the toner seal 360 held in contact with the cylindrical surface 31B of the photosensitive drum 31 with respect to the end 3581 of the plate lower portion 358S along a direction of extension of the housing rear wall 35H1 toward the cylindrical surface 31B. Therefore, toner particles scattered from the abrasive roller 353 and hitting the housing rear wall 35H1 fall in an area nearer to the second conveying screw 361 than the fixed end 360F of the toner seal 360. Thus, the fallen toner is appropriately collected by the second conveying screw 361.

Furthermore, preferably, the second conveying screw 361 has a smaller diameter than the abrasive roller 353 and the housing rear wall 35H1 is disposed above the second conveying screw 361 and facing the abrasive roller 353. In this case, even if toner particles scattered from the abrasive roller 353 hit the housing rear wall 35H1, the hit toner particles fall along the housing rear wall 35H1 and are then conveyed by the second conveying screw 361.

Although the drum units 31H and image forming apparatuses 1 including their respective cleaning devices 35 according to the above embodiments of the present disclosure have thus far been described, the present disclosure is not limited to them and can take, for example, the following modified embodiments.

(1) Although the above embodiments have described a structure in which the second conveying screw 361 includes a shaft and a spiral fin member provided around the shaft, the present disclosure is not limited to this structure. In place of the second conveying screw 361, a spiral coil spring may be rotatably disposed to extend in the axial direction of the photosensitive drum 31 or a spirally wound brush may be rotatably disposed.

(2) Although the above embodiments have described a structure in which the abrasive roller 353 and the cleaning blade 351 are disposed downstream of the toner seal 360 in the direction of rotation of the photosensitive drum 31, the present disclosure is not limited to this structure. The abrasive roller 353 may be a cleaning roller configured to clean the surface of the photosensitive drum 31. In this case, the cleaning blade 351 may be disposed downstream of the cleaning roller in the direction of rotation of the photosensitive drum 31 or no cleaning blade may be disposed.

(3) Although the above embodiments have described a structure in which the upper wall 35H2 and the sidewall 35H3 are disposed above and laterally (rearwardly in FIG. 3) of, respectively, the second conveying screw 361, the present disclosure is not limited to this structure. The plate 358 may be disposed laterally (rearwardly in FIG. 3) of and directly facing the second conveying screw 361 or another wall portion may be disposed laterally of the second conveying screw 361.

(4) Although the above embodiments have described a structure in which the cleaning device 35 including the toner seal 360 is disposed in the drum unit 31H, the present disclosure is not limited to this structure. The cleaning device 35 including the toner seal 360 may be installed separately to the image forming apparatus 1.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A cleaning device which is disposed above an image carrier capable of carrying a toner image on a cylindrical surface thereof and rotating about a rotation axis thereof and configured to clean the cylindrical surface, the cleaning device including:

a rotary member including a peripheral surface held in contact with the cylindrical surface of the image carrier above the rotation axis of the image carrier, the rotary member being configured to be driven into rotation so that the peripheral surface thereof travels, at a contact position thereof with the image carrier, in the same direction as but with a linear speed difference from the image carrier and thereby allow toner deposited on the cylindrical surface of the image carrier to adhere to the peripheral surface of the rotary member;

a sheet member including a distal end extending toward the cylindrical surface of the image carrier, the sheet member being in contact at the distal end with the cylindrical surface of the image carrier above the rotation axis thereof and upstream of the contact position of the rotary member in a direction of rotation of the image carrier; and a toner conveying member which includes a rotation axis extending in a direction of length of the rotary member, is disposed above the sheet member and facing the peripheral surface of the rotary member, further includes a spiral member provided around the rotation axis thereof to extend in an axial direction of the rotation axis, and is configured to be driven into rotation about the rotation axis, wherein a first standing wall is provided lateral to the toner conveying member and to the opposite side of the toner conveying member to the rotary member to face the toner conveying member, and the cleaning device further including a support member which is disposed to a lateral portion of a housing of the cleaning device and extends from the lateral portion of the housing toward the cylindrical surface of the image carrier, one end of the sheet member being attached to an end of the support member located toward the cylindrical surface of the image carrier, the support member supporting the sheet member, wherein the sheet member is interposed between the support member and the cylindrical surface of the image carrier and, with the one end of the sheet member attached to the support member, the other end of the sheet member is in contact with the cylindrical surface of the image carrier, and the toner conveying member is disposed to avoid that a peripheral edge of the spiral member located above the support member is located in an area nearer to the other end of the sheet member with respect to the end of the support member.

2. The cleaning device according to claim 1, wherein the toner conveying member is driven into rotation so that a portion of the peripheral edge of the spiral member facing the peripheral surface of the rotary member travels downward.

3. The cleaning device according to claim 1, further including an upper wall portion covering the toner conveying member from above.

4. The cleaning device according to claim 1, wherein the toner conveying member has a smaller diameter than the rotary member, and the cleaning device further includes a second standing wall disposed above the toner conveying member and facing the rotary member.

5. The cleaning device according to claim 4, wherein the second standing wall is disposed opposite the other end of the sheet member held in contact with the cylindrical surface of the image carrier with respect to the end of the support member along a direction of extension of the second standing wall toward the cylindrical surface of the image carrier.

6. The cleaning device according to claim 1, further including a cleaning blade which is held in contact with the cylindrical surface of the image carrier downstream of the rotary member in the direction of rotation of the image carrier and is configured to remove toner deposited on the image carrier.

7. An image carrier unit including:

the cleaning device according to claim 1; and the image carrier disposed facing the rotary member.

8. An image forming apparatus including:

the cleaning device according to claim 1;

the image carrier disposed facing the rotary member; and a developing device configured to supply toner to the cylindrical surface of the image carrier.

9. The image forming apparatus according to claim 8, further including:

a sheet conveyance path facing the image carrier and configured to convey a sheet from below upward; and a transfer member held in contact with the cylindrical surface of the image carrier to form a transfer nip where the toner image is to be transferred from the image carrier to the sheet, wherein the image carrier is driven into rotation so that the cylindrical surface thereof travels from below upward at the transfer nip, and the rotary member is held in contact with the cylindrical surface of the image carrier somewhere in between the transfer nip and a position right above the rotation axis.

10. A cleaning device which is disposed above an image carrier capable of carrying a toner image on a cylindrical surface thereof and rotating about a rotation axis thereof and configured to clean the cylindrical surface, the cleaning device including:

a rotary member including a peripheral surface held in contact with the cylindrical surface of the image carrier above the rotation axis of the image carrier, the rotary member being configured to be driven into rotation so that the peripheral surface thereof travels, at a contact position thereof with the image carrier, in the same direction as but with a linear speed difference from the image carrier and thereby allow toner deposited on the cylindrical surface of the image carrier to adhere to the peripheral surface of the rotary member;

a sheet member including a distal end extending toward the cylindrical surface of the image carrier, the sheet member being in contact at the distal end with the cylindrical surface of the image carrier above the rotation axis thereof and upstream of the contact position of the rotary member in a direction of rotation of the image carrier;

a toner conveying member which includes a rotation axis extending in a direction of length of the rotary member, is disposed above the sheet member and facing the peripheral surface of the rotary member, further includes a spiral member provided around the rotation axis thereof to extend in an axial direction of the rotation axis, and is configured to be driven into rotation about the rotation axis;

a cleaning blade which is held in contact with the cylindrical surface of the image carrier downstream of the rotary member in the direction of rotation of the image carrier and is configured to remove toner deposited on the image carrier; and a toner collecting member disposed above the cleaning blade and configured to be driven into rotation to collect the toner removed by the cleaning blade.

11. A cleaning device which is disposed above an image carrier capable of carrying a toner image on a cylindrical surface thereof and rotating about a rotation axis thereof and configured to clean the cylindrical surface, the cleaning device including:

a rotary member including a peripheral surface held in contact with the cylindrical surface of the image carrier above the rotation axis of the image carrier, the rotary member being configured to be driven into rotation so that the peripheral surface thereof travels, at a contact position thereof with the image carrier, in the same direction as but with a linear speed difference from the image carrier and thereby allow toner deposited on the cylindrical surface of the image carrier to adhere to the peripheral surface of the rotary member;

a sheet member including a distal end extending toward the cylindrical surface of the image carrier, the sheet member being in contact at the distal end with the cylindrical surface of the image carrier above the rotation axis thereof and upstream of the contact position of the rotary member in a direction of rotation of the image carrier;

a toner conveying member which includes a rotation axis extending in a direction of length of the rotary member, is disposed above the sheet member and facing the peripheral surface of the rotary member, further includes a spiral member provided around the rotation axis thereof to extend in an axial direction of the rotation axis, and is configured to be driven into rotation about the rotation axis; and a regulating member held in contact with the peripheral surface of the rotary member to regulate the amount of toner adhering to the peripheral surface of the rotary member.

* * * * *